US005682699A

United States Patent [19]

Gentry

[11] Patent Number: 5,682,699

[45] Date of Patent: Nov. 4, 1997

[54] SINGLE-SHOT FALLING BLOCK ACTION RIFLE WITH IMPROVED SAFETY

[76] Inventor: Roger Gentry, 5005 Coronet La., Arlington, Tex. 76017

[21] Appl. No.: 738,636

[22] Filed: Oct. 29, 1996

[51] Int. Cl.[6] ..... F41A 3/00; F41C 7/00

[52] U.S. Cl. ..... 42/23; 42/24; 42/47; 42/65; 42/46; 42/14

[58] Field of Search ..... 42/23, 24, 47, 42/65, 46, 14

[56] References Cited

U.S. PATENT DOCUMENTS

| | | | |
|---|---|---|---|
| 968,228 | 8/1910 | Audette | 42/23 |
| 1,157,656 | 10/1915 | Swebilius | 42/23 |
| 3,355,833 | 12/1967 | Ruger et al. | 42/23 |
| 3,382,597 | 5/1968 | Ruger et al. | 42/23 |
| 3,710,493 | 1/1973 | Grämiger et al. | 42/23 |
| 3,733,729 | 5/1973 | Baker | 42/23 |
| 3,830,000 | 8/1974 | Browning | 42/23 |
| 4,010,566 | 3/1977 | Edwards | 42/69 R |
| 4,040,196 | 8/1977 | Smith et al. | 42/23 |
| 4,128,956 | 12/1978 | Foote | 42/23 |
| 4,570,369 | 2/1986 | Gerfen | 42/23 |
| 4,648,190 | 3/1987 | Allen | 42/23 |
| 4,879,827 | 11/1989 | Gentry | 42/23 |

FOREIGN PATENT DOCUMENTS 2611421 9/1977 Germany .

*Primary Examiner*—Charles T. Jordan
*Assistant Examiner*—Meena Chelliah
*Attorney, Agent, or Firm*—Charles D. Gunter, Jr.

[57] ABSTRACT

An improved single-shot rifle is shown having a rifle barrel secured to a receiver and having a lever-activated falling block action. The action includes a hammer and trigger each pivotally connected to the lever. A breechblock is moveable downwardly within a breechblock mortise provided on a rear surface of the receiver from a safety position wherein a firing pin carried thereby is aligned with a recess in the hammer and a firing position in which the firing pin is aligned with a striking surface of the hammer so that pulling the trigger releases the hammer and allows the striking surface thereof to strike the firing pin and fire the rifle.

13 Claims, 4 Drawing Sheets

SINGLE-SHOT FALLING BLOCK ACTION RIFLE WITH IMPROVED SAFETY

BACKGROUND OF THE INVENTION

1. Field of the Invention

The present invention relates generally to single-shot rifles and, more specifically, to a lever-cocked single-shot rifle having a falling block action.

2. Description of the Prior Art

A variety of breechblock rifles are known in the prior art and are characterized according to the different type of action. The specific type of action is determined by the type of movement imparted to the breechblock as the breechblock moves into and out of engagement with the cartridge chamber of the receiver. Typical known actions include the swinging block action, the rolling block action and the falling block action.

A particularly well known falling block design is the Ruger No. 1 Falling Block Action which comprises a lever actuated single-shot mechanism having a breechblock contained, spring biased firing pin mechanism. The Ruger No. 1 design is described in U.S. Pat. No. 3,355,833. A description of other falling block actions can be found in the book "Single-Shot Rifles and Actions" by F. deHass (1969).

Other falling block action rifles are known in the art which feature an exposed hammer as a part of the firing mechanism. For example, see U.S. Pat. No. 4,040,196, issued Aug. 9, 1977, to Smith et al. Falling block rifle actions, particularly those having exposed hammers, have traditionally been lacking in a method of safely carrying the rifle in the loaded condition. By the very nature of firearms, an absolutely fool proof safety mechanism is virtually impossible, since the firearm must at some point be capable of firing its projectile. However, particularly with regard to the falling block action rifles of the type previously discussed, a need exists for an improved safety mechanism which would allow the weapon to be safely carried in the loaded condition.

It is accordingly an object of the present invention to provide a single-shot falling block rifle which has an improved action which is simple and reliable in operation and which is safer than the conventionally available actions for such rifles.

SUMMARY OF THE INVENTION

Because the rifle of the invention is not intended to be a combat arm or to be fired on a split seconds notice, it is designed to utilize a sequence of operations in order to place the rifle in the ready-to-fire condition. A main feature of the action of the invention is that this sequence of operations must be repeated each time the rifle is fired. The sequence of operations improves the safety factor of the operation of the action since the rifle hammer is not capable of striking the firing pin in the safety position.

The falling block rifle of the invention has an improved action which is simple in design and economical to manufacture and which exhibits aesthetically pleasing lines while accommodating a variety of different calibers. The rifle includes a barrel having opposing ends with a receiver mounted on one end of the barrel. The receiver has a forward face which joins the barrel and a rearward face. The rifle has a lever-activated falling block action with a hammer and trigger each pivotally connected to the lever. The action comprises a breechblock moveable downwardly within a breechblock mortise from a safety position wherein a firing pin carried thereby is aligned with a recess in the hammer to a firing position in which the firing pin is aligned with the striking surface of the hammer so that pulling the trigger releases the hammer and allows the striking surface thereof to strike the firing pin and fire the rifle.

The breechblock is moveable vertically downwardly within the breechblock mortise by means of finger pressure applied by a rifle user to thereby move the breechblock from the safety position to the firing position. The firing pin, which is carried by the breechblock, has a front tip which is aligned with the cartridge located in the receiver chamber when the breechblock is in the firing position. The firing pin also has a normally exposed rear surface which is acted upon by the striking surface of the hammer when the trigger is pulled. The firing pin is spring biased to normally expose the rear surface thereof from the breechblock.

The lever is joined to the breechblock by means of a horizontally mounted pin which is press-fitted within the breechblock and which travels in a vertical slot provided in the lever. After a cartridge is fired, the first movement of the lever causes the pin to travel downwardly in the slot and moves the hammer downwardly before any movement of the breechblock to thereby align the spring biased firing pin with the recess provided in the hammer. The hammer is pivoted between a cocked position and the firing position by means of a pivot link. The pivot link is biased by a main spring carried in a main spring housing in the rifle stock so that the pivot link acts upon the hammer and, in turn, the lever to bias the lever between a fully open and cocked position and a fully closed, firing position.

The lever includes an upwardly extending pin tower with a forward surface which contacts the rear face of the receiver in a rest position, whereby the lever bears on the receiver to transfer main spring pressure from the action of the pivot link on the hammer to the receiver instead of to the breechblock. The hammer and firing pin of the rifle are left in a safety position after the lever is moved from the rest position through a loading position in which a cartridge is loaded into the rifle chamber by virtue of the firing pin being received within the recess provided in the hammer. The rifle is then placed in the firing position by manually cocking the hammer and moving the breechblock downwardly within the breechblock mortise to thereby align the hammer striking surface with the rear surface of the firing pin.

Additional objects, features and advantages will be apparent in the written description which follows.

DETAILED DESCRIPTION OF THE INVENTION

Figure 1:
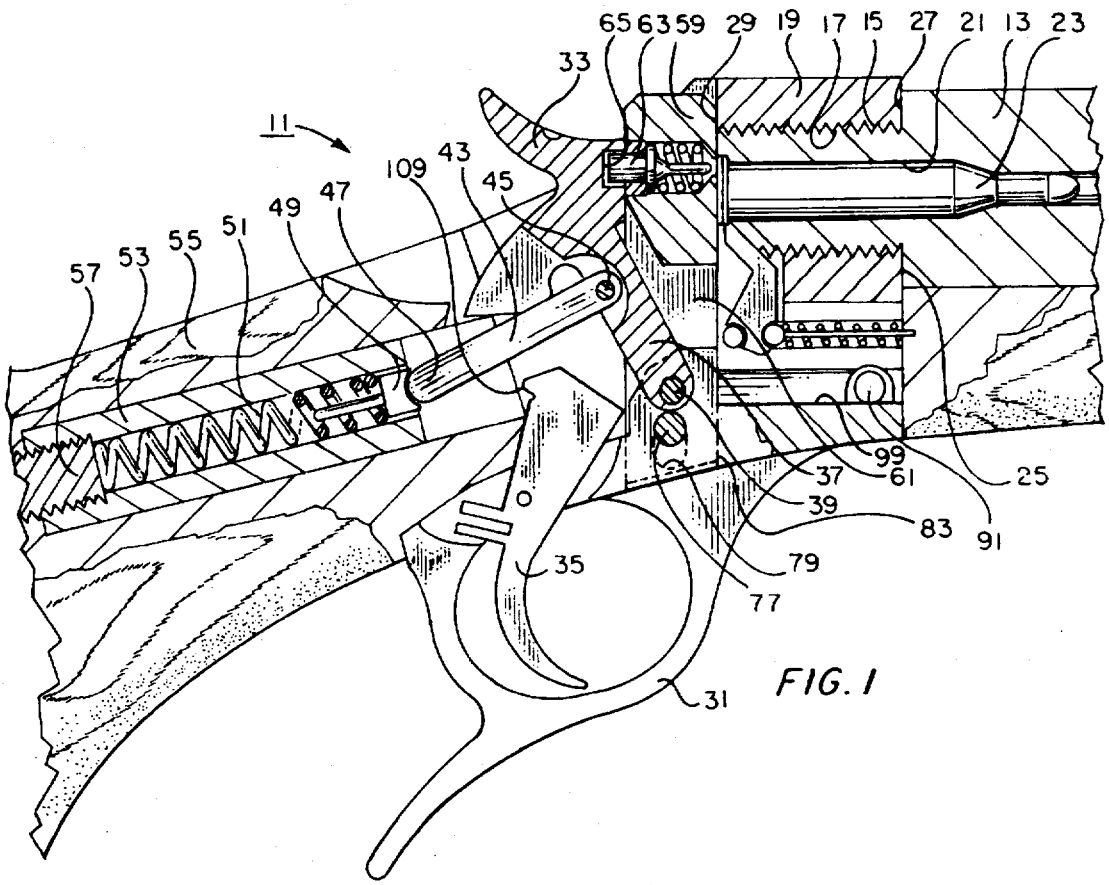
FIG. 1 is a side view of the falling block action of the rifle of the invention, partially in section with the hammer and breechblock in the safety position and the lever in the rest position.

Turning to FIG. 1, the action of the single-shot rifle of the invention is illustrated in partial cross-section with portions of the barrel and stock shown cut away. The rifle, designated generally as 11, includes a barrel 13 one end of which terminates in a threaded exterior 15 which engages a mating threaded interior 17 of the rifle receiver 19. As shown in FIG. 1, the barrel and receiver form a cartridge chamber 21 for receiving a cartridge 23 when the rifle is in the loaded, safety position illustrated.

The receiver 19 has a forward face 25 which abuts a rear surface 27 of the barrel 13 and has a rearward face 29. The rifle of the invention also features a lever-activated falling block action which will be described. In addition to the operating lever 31 the action includes an exposed hammer 33 and a trigger 35 each of which is pivotally connected to the lever 31. As seen in FIG. 1, the hammer 33 includes downward leg 37 which is pinned at a pivot point 39 to a pin tower portion 41 (FIG. 2) of the lever 31. The hammer 33 is pivoted between a cocked position shown in FIG. 4 and a firing position shown in FIG. 5 by means of a pivot link 43 (FIG. 1). The link is attached at one end to the hammer by means of pivot point 45 and has an opposite end 47 which is acted upon by the carrier 49 of the main spring 51. As shown in FIG. 1, the main spring 51 is located within a sleeve 53 affixed within the rifle stock 55 by a threaded lug 57.

Figure 2:
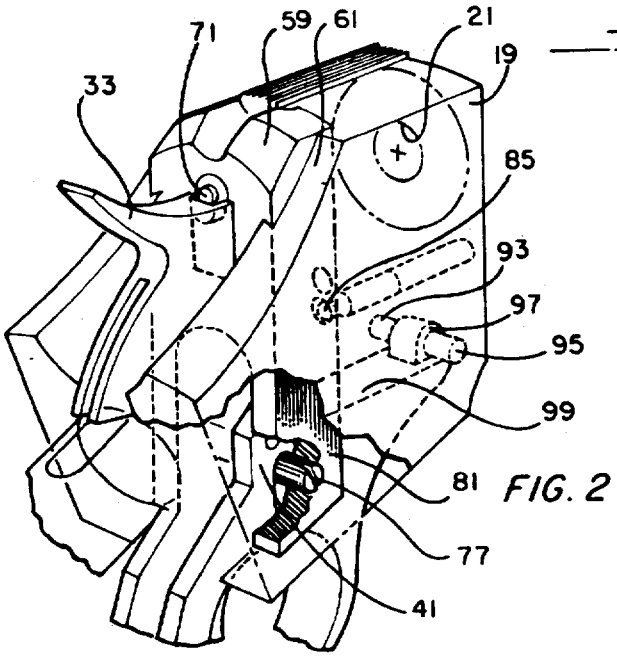
FIG. 2 is an isolated view of the receiver and portions of the breechblock, hammer and lever of the falling block action of the rifle of the invention.
Figure 3:
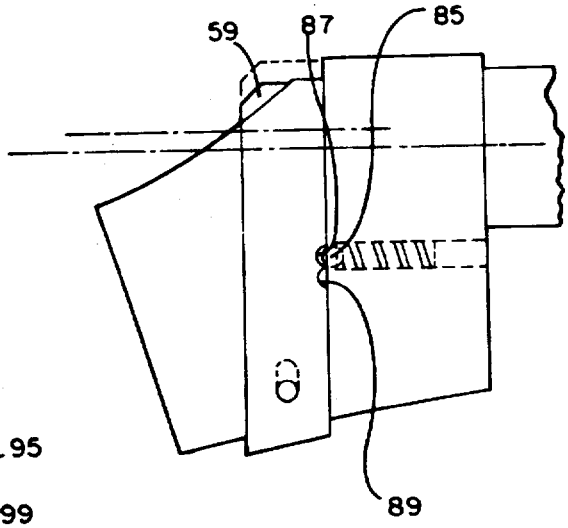
FIG. 3 is a simplified, schematic view of the movement of the breechblock between the two detent positions thereof.

As shown in FIGS. 1–3, a breechblock 59 is moveable downwardly within a breechblock mortise 61 from a safety position (FIG. 1) wherein a firing pin 63 carried thereby is aligned with a recess 65 in the hammer 33 to a firing position (FIG. 5) in which the firing pin 63 if aligned with a striking surface 67 of the hammer 33 so that pulling the trigger 35 releases the hammer 33 and allows the striking surface 67 thereof to strike the firing pin 63 and fire the rifle.

Figure 4:
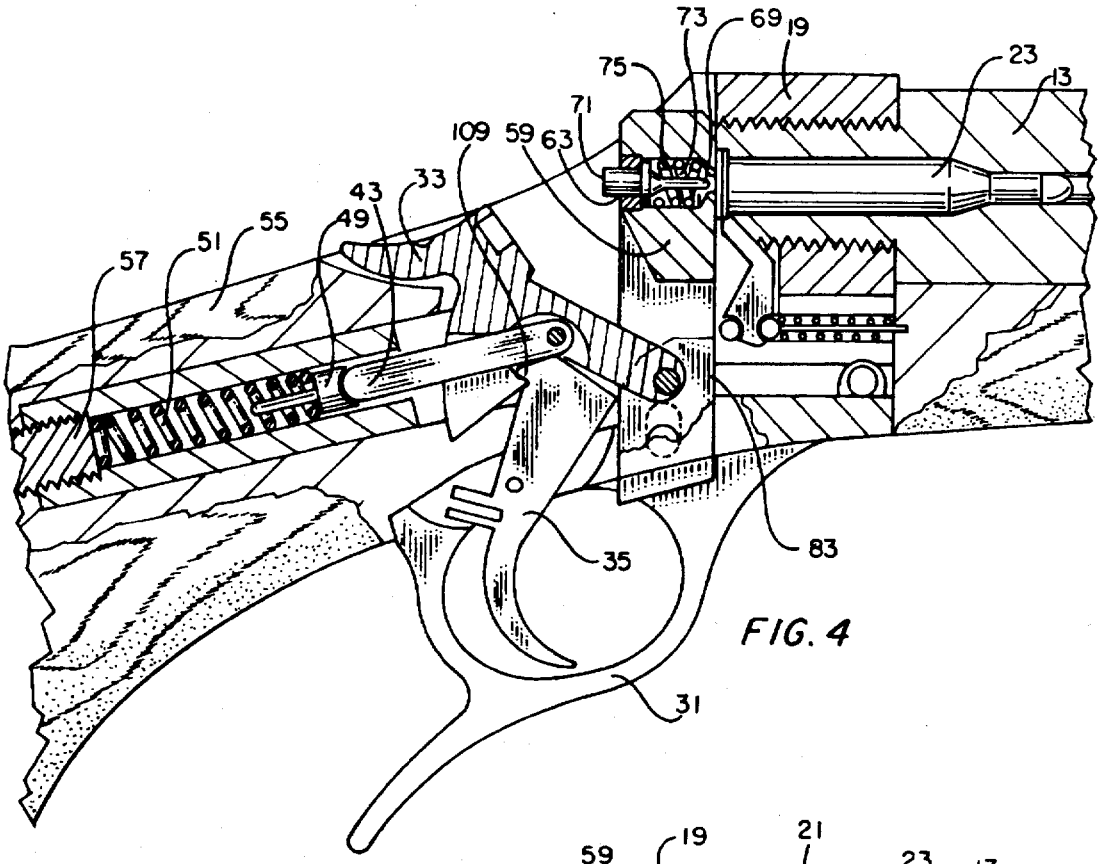
FIG. 4 is a side, partial sectional view of the rifle action similar to FIG. 1 showing the movement of the hammer to the cocked position.
Figure 5:
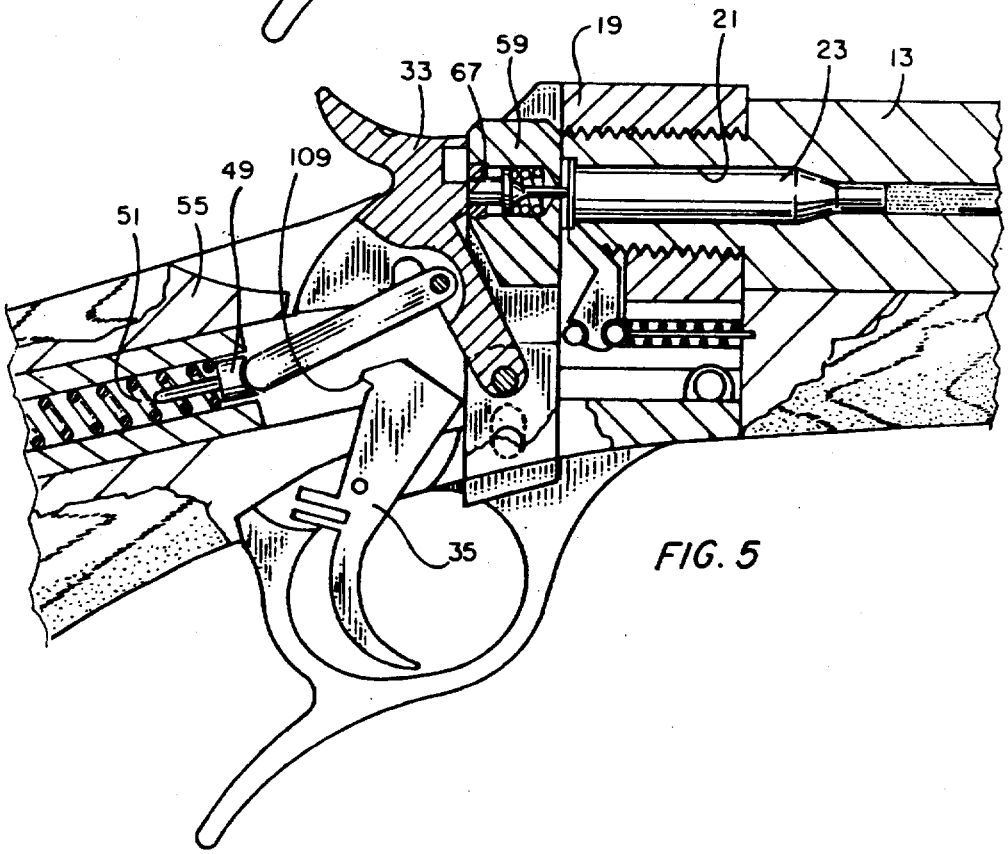
FIG. 5 is a view similar to FIG. 4 showing the movement of the hammer to the firing position, striking the firing pin and igniting the cartridge primer.

The breechblock 59 is moveable vertically downwardly within the breechblock mortise 61 by means of finger pressure applied by a rifle user to thereby move the breechblock 59 from the safety position shown in FIG. 1 to the firing position shown in FIGS. 4 and 5. As best seen in FIG. 4, the firing pin 63 has a front tip 69 which is aligned with the primer of the cartridge 23 located in the receiver chamber 21 when the breechblock is in the firing position. The firing pin 63 also has a normally exposed rear surface 71 which is spring biased outwardly by means of coil spring 73 located in the horizontal bore 75 of the breechblock 59.

The lever 31 has a vertical slot 79 formed in a pin tower region 83 thereof and is joined to the breechblock 59 by means of a horizontal pin 77 (FIG. 1) which is press-fitted within the downwardly extending flanges (81 shown in FIG. 2) of the breechblock 59. After a cartridge is fired, the first movement of the lever moves the hammer 33 downwardly, due to the movement of the pin 77 in the slot 79, before any movement of the breechblock 59 to thereby align the spring biased firing pin 63 with the recess 65 provided in the hammer. As shown in FIGS. 1 and 4, the upwardly extending pin tower region 83 of the lever contacts the rear face 29 of the receiver 19 in the rest position, whereby the lever 31 bears on the receiver 19 to transfer the main spring pressure from the action of the pivot link 43 on the hammer 33 to the receiver 19 instead of to the breechblock 59.

The breechblock 59, as illustrated in FIG. 3, is retained in either the safety position (shown in dotted lines) or the firing position by means of a spring loaded detent 85 which is engaged in one of two detent positions 87, 89. Detent position 87 is the safety position and detent position 89 is the firing position.

Figure 7:
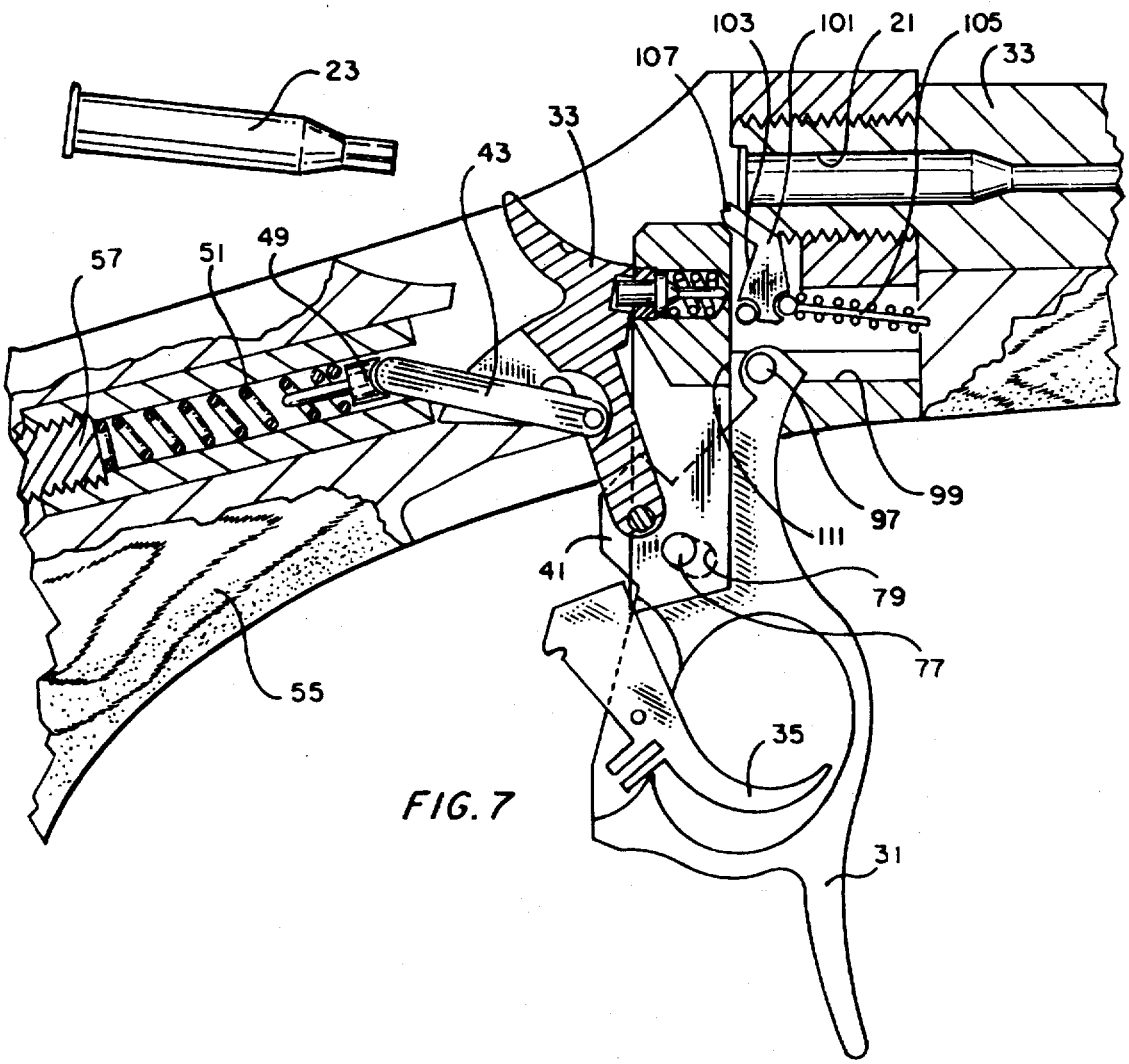
FIG. 7 is a view similar to FIG. 6 showing the completed downward travel of the lever to eject the spent cartridge.

The lever 31 itself has a primary pivot point (91 in FIG. 1) which is formed by means of the oppositely extending pin ends 93, 95 (FIG. 2) of the primary pivot pin 97. The pin 97 travels back and forth within a horizontal slot or track 99 as the lever is moved between the rest position shown in FIG. 1 and the full downward position shown in FIG. 7. As shown in FIG. 7, an ejector 101 has a cam surface 103 which is acted upon during the cocking action of the rifle, whereby the spring biased actuator 105 causes the ejector outer extent 107 to engage the cartridge lip and eject the spent cartridge from the rifle.

The operation of the improved single-shot rifle of the invention will now be described. To expose the chamber 21 for loading, the operating lever 31 is pivoted from the rest position shown in FIG. 1 downwardly to the position shown in FIG. 7. Movement of the lever lowers the breechblock 59 and the hammer 33 so that a cartridge 23 can be placed in the chamber 21. Pivoting the operating lever 31 in an upward direction raises the breechblock 59 and hammer 33 and leaves the breechblock 59 in the safety position with its firing pin 63 above the horizontal position of the primer of the cartridge 23 (FIG. 1). In this position, the firing pin rear face 71 (FIG. 2) is received within the recess 65 provided on the face of the hammer 33. This prevents the breechblock 59 from being pushed downward into a firing position and prevents the hammer 33 from contacting the firing pin 63. The hammer 33 and firing pin 63 are safely kept out of battery regardless of the position of the breechblock, i.e., even if the lever is repeatedly cocked.

To fire the rifle, the hammer 33 is manually retracted to the cocked position (FIG. 4) by thumb pressure until the hammer 33 has engaged the trigger sear 109 (FIG. 4). At this point in the operation, the breechblock 59 is held in the upward position of FIG. 1 by the action of the spring loaded detent (85 in FIGS. 2 and 3). By manually pushing the breechblock downwardly within the mortise 61 to the firing position (FIG. 4), the firing pin tip 69 is aligned with the primer of the cartridge 23 and the rifle is ready to fire. Pulling the trigger disengages the hammer from the sear 109, allowing the hammer to fall to the position shown in FIG. 5, allowing the striking surface 67 thereof to strike the firing pin 63 and, in turn, the primer of the cartridge 23.

Figure 6:
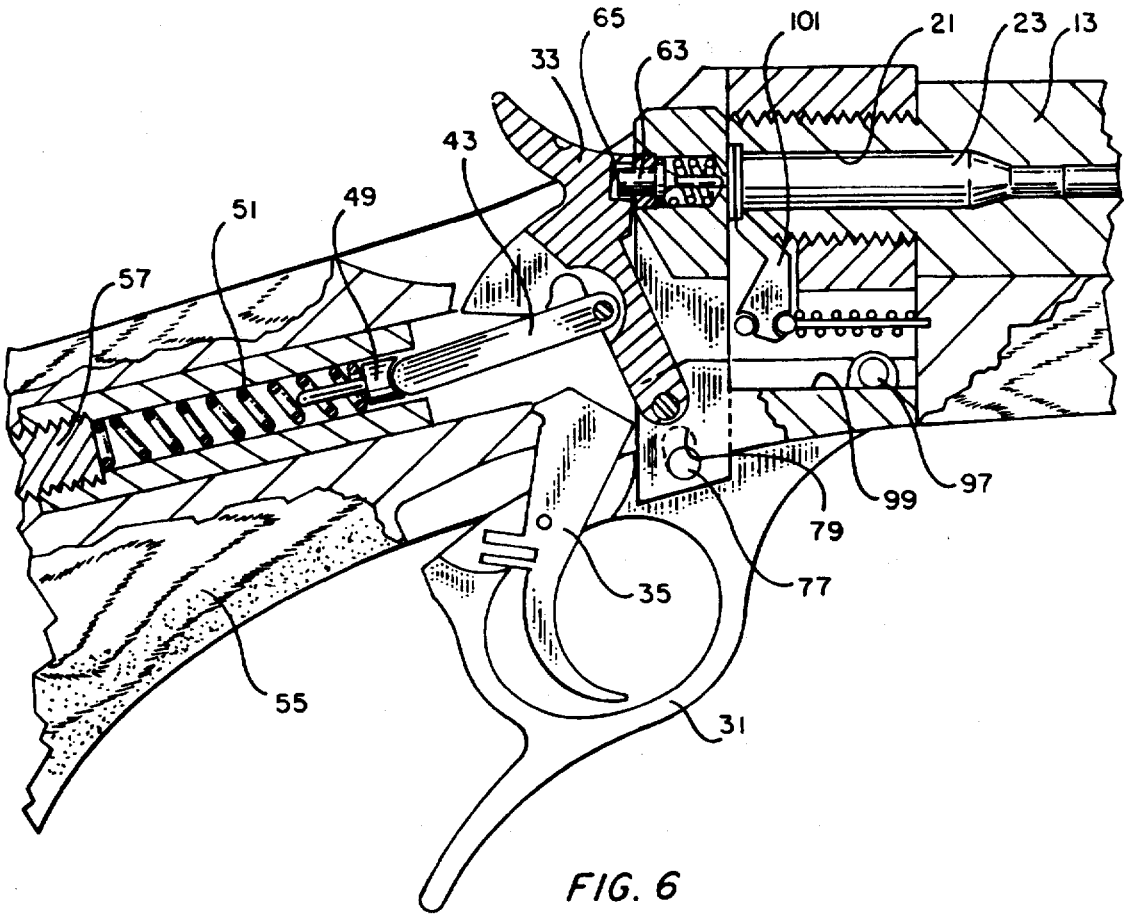
FIG. 6 is a view similar to FIG. 5 showing the initial downward movement of the lever to cock the rifle.

After the cartridge has fired, the operating lever is pivoted downwardly. Upon the first movement of the lever 31, the hammer 33 (being pinned to the operating lever) lowers until the recess 65 thereof and the firing pin 63 are aligned (FIG. 6). Once they are aligned, the firing pin 63 is retracted into the hammer recess 65 by the outward spring bias of the firing pin 63. The firing pin 63 then holds the breechblock in an out-of-battery position in all subsequent operating lever positions. As the hammer 33 and firing pin 63 reach alignment, the horizontal pin 77 reaches the bottom of the vertical slot 79 in the operating lever (FIG. 6). This action allows the breechblock 59 to be lowered without undue strain on the firing pin 63.

As the operating lever 31 is lowered, the primary pivot pin 97 thereof rides in the track 99 (see FIGS. 6 and 7) which is milled 90° horizontally from the breechblock mortise face 111. This pin movement allows the operating lever to adjust its pivot pin position automatically as the breechblock 59 lowers, thus eliminating the need for the more complicated linkage assembly which is usually necessary in a three-pivot-point arrangement such as is utilized herein. As the operating lever pin tower moves toward the breechblock 59 during the process of the opening of the action, it contacts the cam surface 103 of the ejector 101 (FIG. 7), thereby pivoting the ejector 101 rearward, causing the outer extend 107 thereof to engage the cartridge rim and eject the cartridge.

As the action is closed by pivoting the operating lever 31 from the full downward position shown in FIG. 7 back to the rest position shown in FIG. 1, the hammer 33 and breechblock 59 are held locked together by the firing pin 63 being received in the recess 65 of the hammer. When the operating lever 31 has reached its full rest position (FIG. 1) the forward face of the hammer pin tower on the operating lever contacts the mating surface of the receiver (FIG. 1). In this position, pressure from the main spring 51 is transferred to the receiver 19, relieving the breechblock 59 of any undue spring pressure.

An invention has been provided with several advantages. The falling block action of the rifle of the invention is simple in design and economical to manufacture. The manual operation of the hammer and breechblock provide improved safety over conventional designs. There are several differences in the design which distinguish it from the conventional falling block action including the fact that the hammer is pinned to the lever, rather than to the breechblock; the hammer can begin its downward movement without initially moving the breechblock; the hammer is not cammed backwardly upon the initial motion of the lever but rather the hammer is moved in a downward movement; the breechblock is set at a 90° angle in the design and; the pivot points of the lever and action are such that the lever is automatically biased between the rest position and full open position. In the improved design, the breechblock must be moved in and out of battery manually each time the weapon is fired, effectively constituting a selective safety for the weapon. The lever tower region bears on the receiver to transfer main spring pressure to the receiver, rather than to the breechblock. The hammer recess which engages the firing pin locks the action in a closed position with the breechblock always being in the safe position.

Because the firing pin is out of battery with the primer of the cartridge in the safe position, the weapon remains disabled if, during cocking of the hammer, the hammer should accidentally slip and fall. In most conventional designs, this type safety is provided on falling block actions by a half cock notch on the hammer which engages the trigger sear. The rifle action of the invention is a distinct advantage over such systems in that it relies upon an out-of-battery alignment of the hammer and firing pin, instead of relying upon a physical catch system of the half cock notch style which can fail after repeated usage.

While the invention has been shown in only one of its forms, it is not thus limited but is susceptible to various changes and modifications without departing from the spirit thereof.

What is claimed is:

1. A single-shot rifle, comprising:

a barrel having opposing ends;

a receiver mounted on one end of the barrel, the receiver having a forward face which joins the barrel and a rearward face;

a lever-activated falling block action;

a hammer and trigger each pivotally connected to the lever;

and wherein said action comprises a breechblock movable downwardly within a breechblock mortise from a safety position wherein a firing pin carried thereby is aligned with a recess in the hammer to a firing position in which the firing pin is aligned with a striking surface of the hammer so that pulling the trigger releases the hammer and allows the striking surface thereof to strike the firing pin and fire the rifle.

2. The rifle of claim 1, wherein the receiver has an internally threaded bore which receives a mating externally threaded portion of the barrel end, the barrel end having a chamber therein for receiving a rifle cartridge.

3. The rifle of claim 1, wherein the breechblock is movable vertically downwardly within the breechblock mortise by means of manual pressure applied by a rifle user to thereby move the breechblock from the safety position to the firing position.

4. The rifle of claim 3, wherein the firing pin which is carried by the breechblock has a front tip which is aligned with the cartridge located in the receiver chamber when the breechblock is in the firing position, the firing pin having a normally exposed rear surface which is acted upon by the striking surface of the hammer when the trigger is pulled.

5. The rifle of claim 4, wherein the firing pin is spring biased to normally expose the rear surface thereof from the breechblock.

6. The rifle of claim 5, wherein the lever is joined to the breechblock by means of a pin press-fitted with the breechblock which travels in a slot provided in the lever, whereby after a cartridge is fired, the first movement of the lever moves the hammer downwardly before any movement of the breechblock to thereby align the spring biased firing pin with the recess provided in the hammer.

7. The rifle of claim 6, wherein the hammer is pivoted between a cocked position and a firing position by means of a pivot link, the pivot link being biased by a mainspring carried in a mainspring housing in the rifle stock so that the hammer is biased between a fully open, cocked position and a fully closed, firing position.

8. The rifle of claim 7, wherein the lever includes an upwardly extending pin tower with a forward surface which contacts the rear face of the receiver in a rest position whereby the lever bears on the receiver to transfer mainspring pressure from the action of the pivot link on the hammer to the receiver instead of to the breechblock.

9. The rifle of claim 8, wherein the hammer and firing pin of the rifle are in a safety position after the lever is moved from the rest position through a loading position in which a cartridge is loaded into the chamber by virtue of the firing pin being received within the recess provided in the hammer.

10. The rifle of claim 9, wherein the rifle is placed in a firing position by manually cocking the hammer and moving the breechblock downwardly within the breechblock mortise to thereby align the hammer striking surface with the rear surface of the firing pin.

11. A receiver for a single-shot rifle having a rifle barrel secured to said receiver and having a lever-activated falling block action, the action comprising a hammer and trigger each pivotally connected to the lever, a breechblock movable downwardly within a breechblock mortise provided on a rear surface of the receiver from a safety position wherein a firing pin carried thereby is aligned with a recess in the hammer to a firing position in which the firing pin is aligned with a striking surface of the hammer so that pulling the trigger releases the hammer and allows the striking surface thereof to strike the firing pin and fire the rifle.

12. The receiver of claim 11, wherein the lever is pivotally connected to said receiver and to the breechblock to move said breechblock and hammer downwardly from and upwardly to said safety position within said breechblock mortise responsive to swinging the lever in opposite directions.

13. A method of firing a single-shot rifle of the type having a barrel having opposing ends and having a receiver mounted on one end of the barrel, the receiver having a forward face which joins the barrel and a rearward face which accesses a cartridge chamber for accepting a cartridge, the rifle having a lever-activated falling block action with a hammer and trigger each pivotally connected to the lever, the method comprising the steps of:

providing a breechblock as a part of the action which is movable downwardly within a breechblock mortise from a safety position wherein a firing pin carried thereby is aligned with a recess in the hammer to a firing position in which the firing pin is aligned with a striking surface of the hammer so that pulling the trigger releases the hammer and allows the striking surface thereof to strike the firing pin and fire the rifle;

manually cocking the hammer of the rifle;

manually pushing the breechblock downwardly within the breechblock mortise from the safety position to the firing position; and pulling the trigger to fire the rifle.

* * * * *